US011540574B2

(12) United States Patent
Hong

(10) Patent No.: US 11,540,574 B2
(45) Date of Patent: Jan. 3, 2023

(54) HAIR EXTENSION AND MANUFACTURING AND ATTACHING METHOD OF THE SAME

(71) Applicants: Aderans Company Limited, Tokyo (JP); HIMO INC., Seoul (KR)

(72) Inventor: In Pyo Hong, Seoul (KR)

(73) Assignees: ADERANS COMPANY LIMITED, Tokyo (JP); HIMO LLC, Seoul (KR)

( * ) Notice: Subject to any disclaimer, the term of this patent is extended or adjusted under 35 U.S.C. 154(b) by 179 days.

(21) Appl. No.: 16/627,024

(22) PCT Filed: Jan. 30, 2018

(86) PCT No.: PCT/JP2018/002993
§ 371 (c)(1),
(2) Date: Dec. 27, 2019

(87) PCT Pub. No.: WO2019/003482
PCT Pub. Date: Jan. 3, 2019

(65) Prior Publication Data

US 2020/0121012 A1 Apr. 23, 2020

(30) Foreign Application Priority Data

Jun. 30, 2017 (KR) ..... 10-2017-0083105

(51) Int. Cl.
*A41G 5/00* (2006.01)

(52) U.S. Cl.
CPC ..... *A41G 5/008* (2013.01); *A41G 5/0046* (2013.01)

(58) Field of Classification Search
CPC .... A41G 5/0013; A41G 5/002; A41G 5/0026; A41G 5/0053; A41G 5/006; A41G 5/0046; A41G 5/0066
See application file for complete search history.

(56) References Cited

U.S. PATENT DOCUMENTS

2001/0037813 A1 11/2001 Ra
2003/0234027 A1* 12/2003 Smith ..... A41G 5/0066 132/201

(Continued)

FOREIGN PATENT DOCUMENTS

CN 105101826 11/2015
JP 10-53910 2/1998

(Continued)

OTHER PUBLICATIONS

Office Action dated May 6, 2021 in Chinese Patent Application No. 201880000991.X, with English-language translation.

(Continued)

*Primary Examiner* — Rachel R Steitz
(74) *Attorney, Agent, or Firm* — Wenderoth, Lind & Ponack, L.L.P.

(57) ABSTRACT

For obtaining a natural-looking hair without excessive volume compared with traditional hair extensions, there are provided a hair extension and manufacturing & attaching method of the same, comprising a linearly extending base member (200); a plurality of hair extension strands (300) to be provided longitudinally along the base member (200), each of the plurality of hair extension strands (300) including a knot part (310) being a knot formed on the base member (200) and a hair part (330) extending from the knot part (310); and a fixing part (400) to be fixed to a portion of the hair part (330) so as to be adjacent to the base member (200) for connecting the plurality of the hair extension strands (300) to the hair of a subject.

8 Claims, 5 Drawing Sheets

(56) References Cited

U.S. PATENT DOCUMENTS

| | | | |
|---|---|---|---|
| 2004/0173233 | A1 | 9/2004 | Tokko |
| 2008/0276949 | A1 | 11/2008 | Lee |
| 2009/0126748 | A1 | 5/2009 | Kim |
| 2009/0126753 | A1 | 5/2009 | Sugai et al. |
| 2011/0079233 | A1 | 4/2011 | Cheh |
| 2012/0125356 | A1 | 5/2012 | Alex |
| 2013/0133680 | A1 | 5/2013 | Wang |
| 2016/0015106 | A1 | 1/2016 | Toba et al. |
| 2017/0065014 | A1 | 3/2017 | Kenna |

FOREIGN PATENT DOCUMENTS

| | | |
|---|---|---|
| JP | 11-131313 | 5/1999 |
| JP | 2005-232614 | 9/2005 |
| JP | 2006-70376 | 3/2006 |
| JP | 3915081 | 5/2007 |
| JP | 2008-517173 | 5/2008 |
| JP | 5075289 | 11/2012 |
| JP | 2015-196941 | 11/2015 |
| KR | 20-0365087 | 10/2004 |
| KR | 10-2005-0010277 | 1/2005 |
| KR | 10-2007-0057982 | 6/2007 |
| KR | 10-2008-0098974 | 11/2008 |
| KR | 10-2014-0132096 | 11/2014 |
| WO | 2010/149677 | 12/2010 |
| WO | 2014/156491 | 10/2014 |
| WO | 2016/014058 | 1/2016 |

OTHER PUBLICATIONS

International Preliminary Report on Patentability dated Jan. 9, 2020 in International (PCT) Application No. PCT/JP2018/002993, with English translation.

International Search Report dated May 15, 2018 in International (PCT) Application No. PCT/JP2018/002993.

* cited by examiner

HAIR EXTENSION AND MANUFACTURING AND ATTACHING METHOD OF THE SAME

TECHNICAL FIELD

The present invention relates to a hair extension and manufacturing and attaching methods of the same, and more particularly, relates to a hair extension to be connected to a subject's hair and manufacturing and attaching methods of the same.

BACKGROUND ART

Wigs are formed by hand sewing strands of hair onto a cap made of a thin net and artificial skin and are worn over bald spots or on the entire head to improve a wearer's hairstyle.

Hair extensions may be used to change the length of the wearer's hair or to create unique hairstyles, Hair extensions are numerous strands of natural or artificial hair cut into predetermined lengths and formed into a bundle.

Generally, there are tape-in type hair extensions, ring type hair extensions and knot type hair extensions, and hair extensions in which a plurality of strands of hair is tied to a string-like base part have also been proposed. (See, for example, Patent Literature 1).

Patent Literature 1: Japanese Patent Laid-open Publication No. 2006-70376

SUMMARY OF INVENTION

Technical Problems

Conventional tape-in type hair extensions are manufactured by integrating upper end portions of hairs with a coating agent component into planar form or by forming knots by hand on artificial skin or a mesh, which are planar members, to fix the upper end portions of hairs thereto.

However, in the method for integrating the upper end portions of hairs with a coating agent component into planar form, since the upper end portions of hairs are fixed in a planar form to an adhesive agent, it is unnatural when hair extensions are attached because the ends of the upper end portions do not move individually and it looks less natural because of the gloss of the coating agent on the portions that have been fixed to the adhesive agent.

In the method for forming knots by hand on artificial skin or a mesh, which are planar members, to fix the upper end portions of hairs thereto, the ends of the hairs adjacent to the handmade knots are directed in a direction perpendicular to a downward direction and not in the downward direction. Thus, especially when the upper end portions of the hairs are connected to the wearer's hair near the scalp, excessive volume is given to the entire head, which creates an unnatural appearance.

Problems to be Solved

The present invention has been devised to solve the foregoing problems, and it is an object of the present invention to provide a hair extension that creates natural-looking hair without excessive volume at connecting portions to a subject's hair, and manufacturing and attaching methods of the same.

It is also an object of the present invention to provide a hair extension in which each hair extension strand moves individually to create a natural look after the hair extension is attached, and manufacturing and attaching methods of the same.

Solutions to Problems

To achieve the objects described above, a hair extension according to an aspect of the present invention comprises a linearly extending base member, a plurality of hair extension strands to be provided longitudinally along the base member, each of the plurality of hair extension strands including a knot part being a knot formed on the base member and a hair part extending from the knot part, and a fixing part to be fixed to a portion of the hair part so as to be adjacent to the base member for connecting the plurality of hair extension strands to a subject's hair.

A manufacturing method for a hair extension according to an aspect of the present invention comprises a hair extension strand forming step of arranging a plurality of hair extension strands on a linearly extending base member and forming a plurality of knot parts to fix the plurality of hair extension strands to the base member, and a fixing part fixing step of arranging, longitudinally along the base member, a fixing part for attaching the plurality of hair extension strands to a subject's hair and then fixing the fixing part to portions of a plurality of hair parts extending from the plurality of knot parts.

As another aspect of the present invention, an attaching method for a hair extension according to the present invention comprises a hair extension manufacturing step including: a hair extension strand forming step of arranging a plurality of hair extension strands on a linearly extending base member and forming a plurality of knot parts to fix the plurality of hair extension strands to the base member, and a fixing part fixing step of arranging, longitudinally along the base member, a fixing part for attaching the plurality of hair extension strands to a subject's hair and then fixing the fixing part to portions of a plurality of hair parts extending from the plurality of knot parts and a hair extension connecting step of connecting a hair extension manufactured in the hair extension manufacturing step to the subject's hair using the fixing part.

Advantageous Effects of Invention

According to the above aspects of the hair extension and the manufacturing and attaching methods of the same, forming the knot parts on the linear base member and forming the fixing part to be fixed to the subject's hair on the hair parts extending from the knot parts creates natural-looking hair without excessive volume compared with traditional hair extensions.

In addition, according to the above aspects, since the fixing part is fixed to a portion of each of the hair parts, remaining hairs other than the hairs fixed to the fixing part are not fixed and are capable of moving individually. Thus, naturalness of the hair is created such that the hair parts can be combed after the hair extension is attached.

DESCRIPTION OF EMBODIMENTS

Embodiments of the present invention will be described in detail below with reference to the accompanying drawings.

The embodiments described below are embodiments suitable for understanding the technical features of a hair extension and manufacturing and attaching methods of the same according to the present invention. It is to be understood, however, that applications of the present invention are not limited to the embodiments described below, that the technical features of the present invention are not limited to the embodiments described, and that various modifications are possible within the technical scope of the present invention.

(Hair Extension According to Embodiments of the Present Invention)

Figure 1:
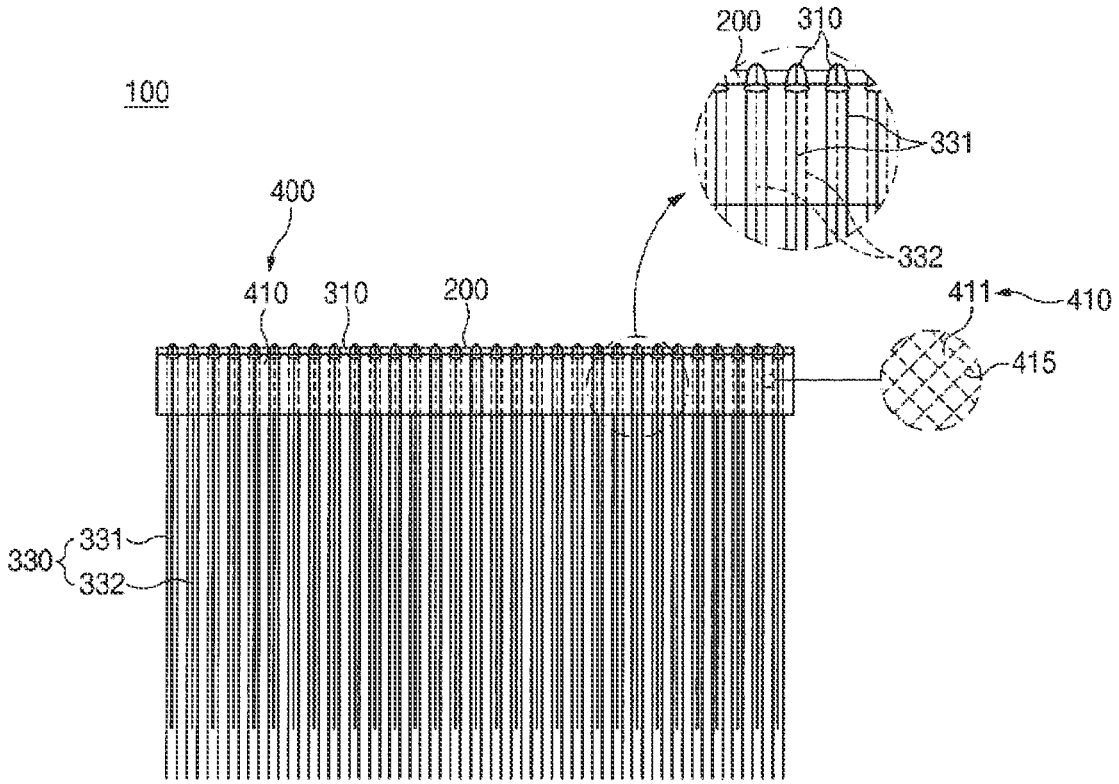
FIG. 1 is a front view illustrating one side of a hair extension according to a first embodiment of the present invention.
Figure 2:
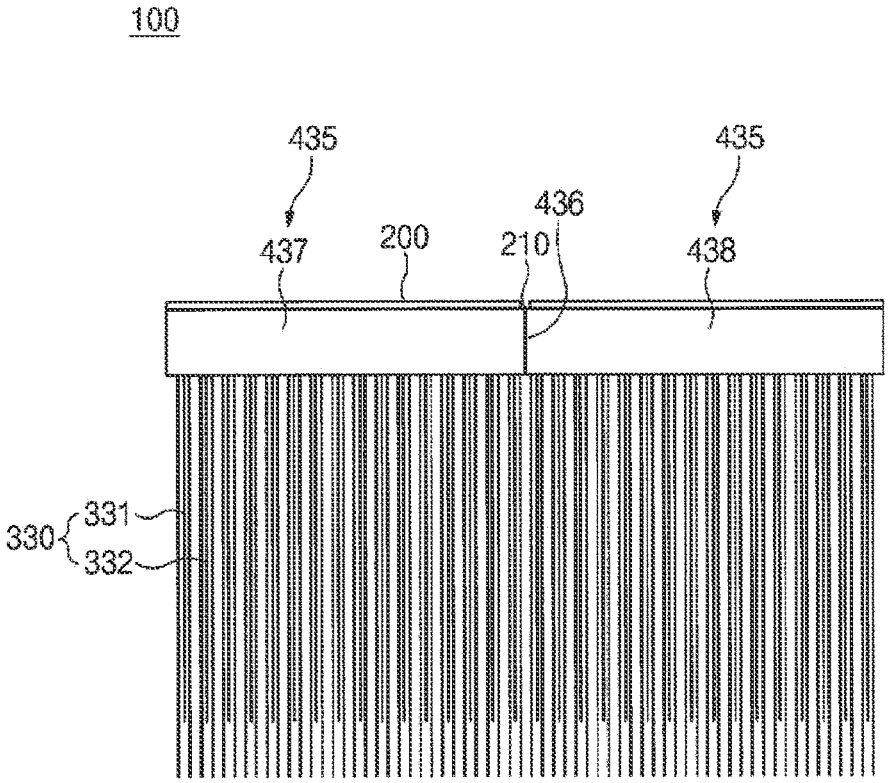
FIG. 2 is a rear view of FIG. 1 illustrating another side of the hair extension according to the first embodiment of the present invention.
Figure 3:
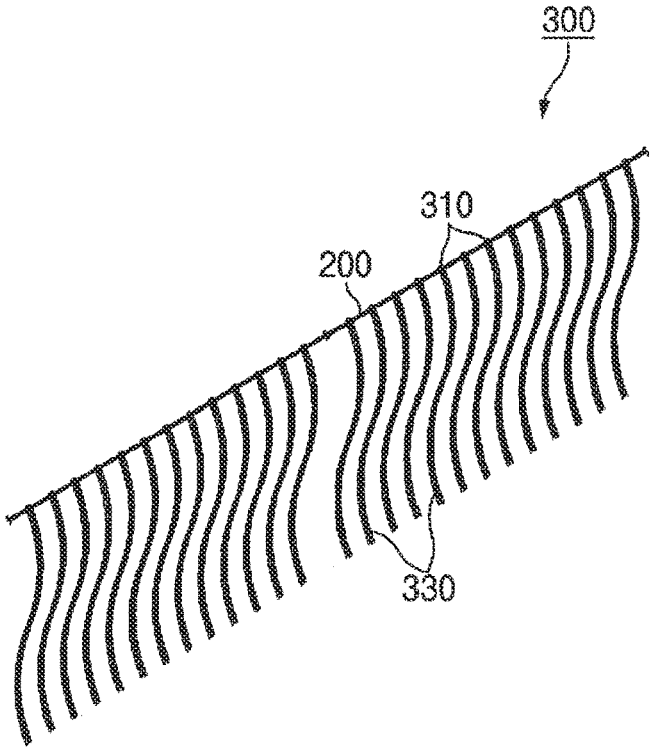
FIG. 3 is a perspective view of hair extension strands applied to the present invention.

A brief general description will first be given of a hair extension according to the embodiments of the present invention with reference to FIGS. 1 to 4. Referring to FIGS. 1 to 3, a hair extension (100) according to the present invention includes a base member (200), hair extension strands (300), and a fixing part (400).

The base member (200) is formed so as to extend linearly. For example, the base member (200) may be provided as a thread, but is not limited thereto, and various other types of elongated linear base members capable of fixing the hair extension strands (300) may be implemented.

The hair extension strands (300) include a knot part (310) being a knot made on the base member (200) and a hair part (330) extending from the knot part (310), and a plurality of the hair extension strands (300) are provided longitudinally along the base member (200) (see, FIG. 3).

Specifically, the plurality of the hair extension strands (300) is provided longitudinally along the base member (200) and includes a plurality of the knot parts (310) and a plurality of the hair parts (330), and various hairs such as natural hair or artificial hair are used therefor. The hair extension strands (300) are fixed to the base member (200) by knot formation of the knot parts (310) and creates natural-looking hair by the hair parts (330) blending with the subject's hair. The knot forming method for the knot parts (310) is not limited, and various knotting methods capable of binding the hair extension strands (300) to the base member (200) may be applied. More desirably, when each knot part (310) is formed, the knot is formed such that the hair part (330) is directed in a direction in which the hair part (330) extends (see, direction A in FIG. 4) at the connecting portion of the knot part (310) to the hair part (330).

The fixing part (400) is fixed to the hair parts (330) so as to be adjacent to the base member (200) for connecting the hair extension strands (300) to the subject's hair.

Specifically, the fixing part (400) is fixed by being attached to or inserted into the hair parts (330) and connects the hair extension strands (300) to the subject's hair by being fixed to the subject's hair when the hair extension is attached.

Here, the fixing part (400) is arranged in a position adjacent to the base member (200), that is, in a position adjacent to the knot parts (310), and is fixed to the hair parts (330) with the fixing part (400) arranged in parallel to the linear base member (200). In addition, the fixing part (400) is fixed to a portion of each hair part (330) (see, FIGS. 1 and 2).

As described above, when the hair extension strands (300) are formed, a knot is formed on the base member (200), which is a linear member such as a thread, to fix the hair extension strands (300) to the base member (200), and the fixing part (400) is fixed to the hair part (330) Of such pre-fabricated hair extension strands (300). Thus, the hair extension (100) according to the present invention creates natural-looking hair without excessive volume of the fixing part (400) compared with conventional cases in which the hair extension strands (300) are handmade and fixed to a planar member such as a net. In addition, since the fixing part (400) is fixed to a portion of each hair part (330), a remaining portion of the hair part (330) to which the fixing part (400) is not secured is not fixed so that each strand thereof moves individually. Thus, naturalness of the hair is created such that the hair part (330) can be combed after being worn by the subject.

The hair part (330) according to the present invention is provided to have directionality in the direction extending from the knot part (310).

More specifically, after the hair part (330) is directed downward from the knot part (310), an adhesive agent is applied between the knot part (310) and the base member (200) to fix the knot part (310) to the base member (200) so that the hair part (330) is provided to have downward directionality from the knot part (310).

Figure 4:
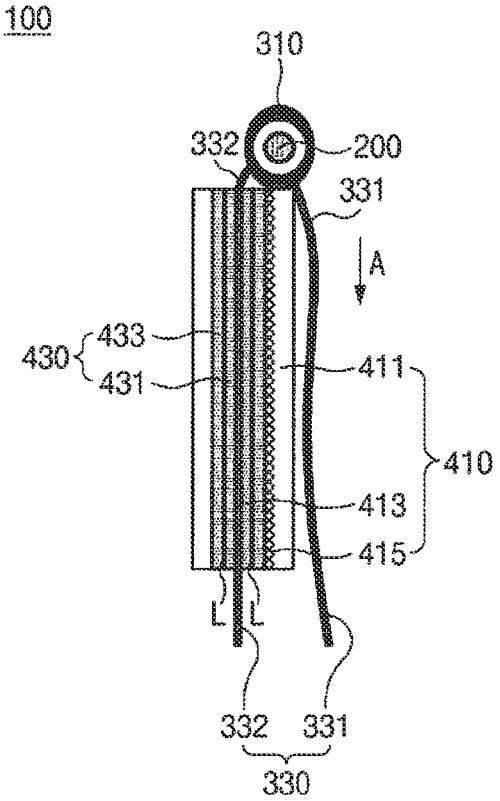
FIG. 4 is a side view of the hair extension illustrated in FIG. 1 as seen from the side.

As a result, the hair extension strands (300) according to the present embodiment have directionality in the direction in which the hair part (330) at the knot part (310) extends (for example, downward; see, direction A in FIG. 4). Thus, the hair extension strands (300) are advantageous in that there is no excessive volume when connected to the subject's hair.

Figure 6:
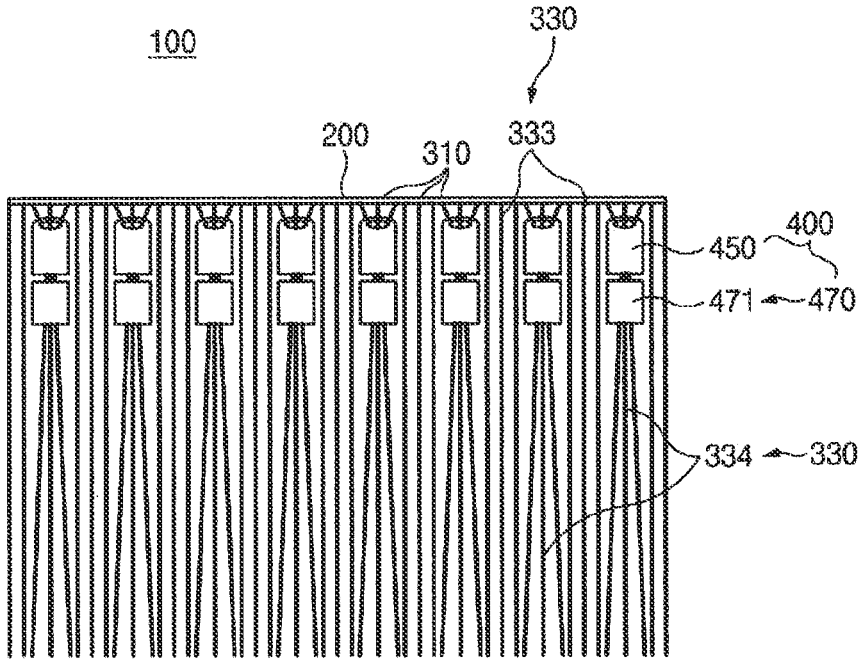
FIG. 6 is a front view illustrating one side of the hair extension according to a second embodiment of the present invention.
Figure 7:
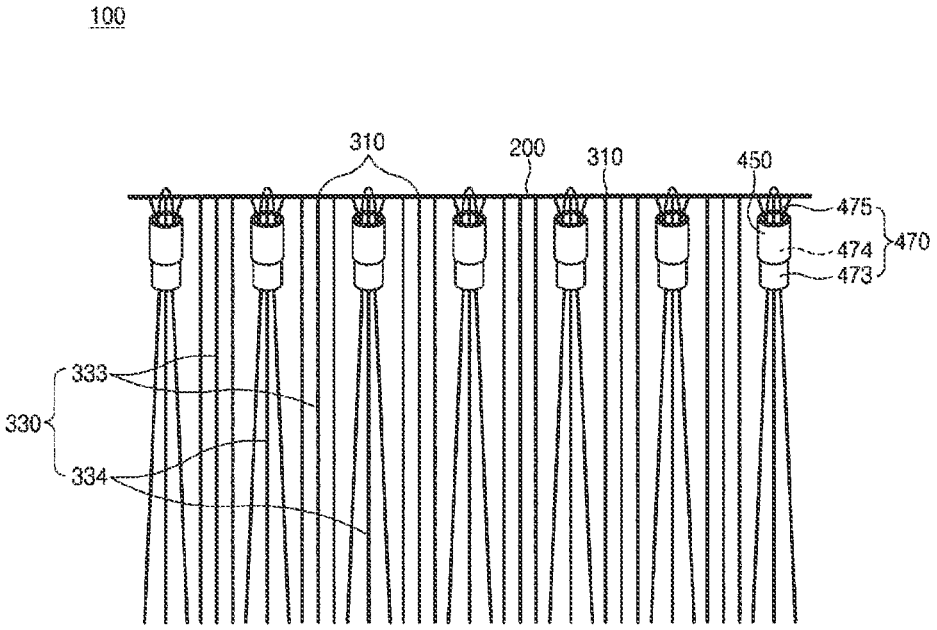
FIG. 7 is a front view illustrating one side of the hair extension according to a third embodiment of the present invention.
Figure 8A:
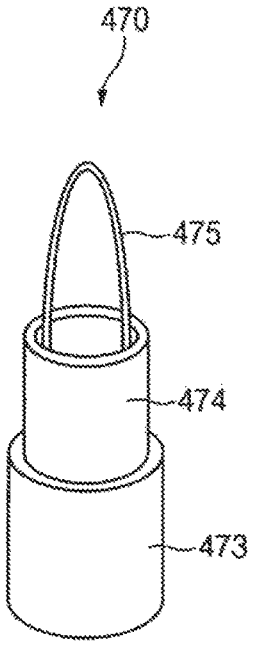
FIG. 8(*a*) is an enlarged perspective view of a fixing part illustrated in FIG. 7 being connected, and FIG. 8(*b*) is a cross-sectional view of the fixing part illustrated in FIG. 7.
Figure 8B:
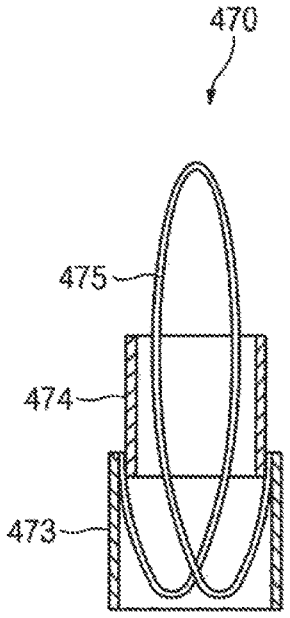
Figures 9A, 9B:
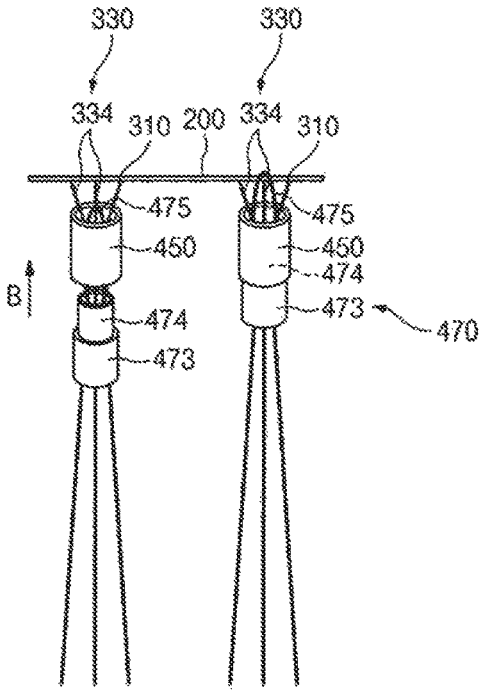
FIG. 9(*a*) is a view illustrating a process of connecting the fixing part to the hair extension strands and FIG. 9(*b*) is a view illustrating the fixing part connected to the hair extension strands.

Various embodiments of the fixing part (400) according to the present invention may be applied as long as the fixing part (400) is fixed to a portion of the hair part (330). For example, FIGS. 1, 2, 4 and 5 illustrate a first embodiment of the fixing part (400), FIG. 6 illustrates a second embodiment of the fixing part (400), and FIGS. 7 to 9 illustrate a third embodiment of the fixing part (400).

(Hair Extension According to First Embodiment)

Referring first to FIGS. 1, 2, 4 and 5, for the fixing part (400) according to the first embodiment, a method for fixing the hair extension strands part (300) by tape-in type is illustrated.

Specifically, the fixing part (400) according to the first embodiment includes a support member (410) and an adhesive member (430).

The support member (410) is provided with a plate-shaped main body (411) longitudinally along the base member (200) and is arranged such that first hairs (331), which are a portion of the hair part (330), are arranged on one side of the main body (411) and such that second hairs (332), which are a remaining portion of the hair part (330), are arranged on another side of the main body (411). The second hairs (332) are fixed to the main body (411) through a first adhesive layer (413) provided on the other side of the main body (411) and thus, the support member (410) supports the hair part (330) (see, FIG. 4).

Specifically, the support member (410) is fixed to the hair part (330) to support the hair extension strands (300) and includes the main body (411) and the first adhesive layer (413). The main body (411) is formed to be elongated in a plate shape and is arranged so as to be adjacent to the base member (200) longitudinally along the base member (200). The first adhesive layer (413) is formed by applying an adhesive agent to the other side of the main body (411) and has a third release paper (not shown) attached to the first adhesive layer (413) to protect the first adhesive layer (413) until being adhered to the second hairs (332).

The hair part (330) is arranged on both sides of the plate-shaped main body (411) with the first hairs (331), which are a portion of the hair part (330), being arranged on the one side of the main body (411) and the second hairs (332), which are the remaining portion of the hair part (330) other than the first hairs (331), being arranged on the other side of the main body (411). After the main body (411) is first arranged such that the one side of the main body (411) faces the hair part (330), a portion of the hair part (330) is drawn out on the other side of the main body (411) to arrange the second hairs (332) on the other side of the main body (411). However, the method for arranging the second hairs (332) is not limited thereto.

The knot part (310) and the hair part (330) including the first hairs (331) and the second hairs (332) described above may be a part of single hair extension strands (300) or may be a plurality of the knot parts (310) and a plurality of the hair parts (330) included together in a plurality of the hair extension strands. Thus, the second hairs (332) may be drawn out from each hair part (330) extending from each knot part (310) or may be drawn out from remaining portions of the hair parts (330) included in the plurality of the hair extension strands (300).

The second hairs (332) are then fixed to the other side of the main body (411) through the first adhesive layer (413). In other words, the other side of the main body (411) is fixed to the second hairs (332), which is a portion of the hair part (330), through the first adhesive layer (413) so that the support member (410) is fixed to a portion of the hair part (330).

The adhesive member (430) is provided so as to face the support member (410) with the second hairs (332) interposed therebetween. A second adhesive layer (431) to which the second hairs (332) are adhered is provided on one side of the adhesive member (430) facing the support member (410), and a third adhesive layer (433) to which the subject's hair is adhered and a release paper (435) that protects the third adhesive layer (433) are provided on another side thereof.

Specifically, the adhesive member (430) is provided in a plate shape and is provided as a double-sided tape in which an adhesive agent is applied to both sides. The adhesive member (430) is arranged so as to face the support member (410) with the second hairs (332) interposed therebetween and includes the second adhesive layer (431), the third adhesive layer (433) and the release paper (435).

The second adhesive layer (431) is provided on the one side facing the support member (410) and has the second hairs (332) adhered thereto, and the adhesive member (430) is fixed to the second hairs (332), which are a portion of the hair part (330). The third adhesive layer (433) has the subject's hair adhered thereto when the hair extension is attached and has the release paper (435) that protects the third adhesive layer (433) attached thereto.

As described above, the fixing part (400) according to the first embodiment of the present invention is advantageous in that the fixing part (400) including the support member (410) is not externally exposed due to the first hairs (331), which are a portion of the hair part (330), arranged on the one side of the support member (410) (see, FIG. 1). In addition, since the first hairs (331) are not adhesively fixed to the support member (410) and each of the first hairs (331) can move individually, naturalness is created such that combing is possible when attached to the subject's head.

The support member (410) includes a lattice structure (415) formed in a lattice on the main body (411) to facilitate support of the main body (411).

Specifically, any method that is capable of forming the lattice structure (415) on the main body (411) and of improving durability of the main body (411) may be applied without limitation.

Figure 5:
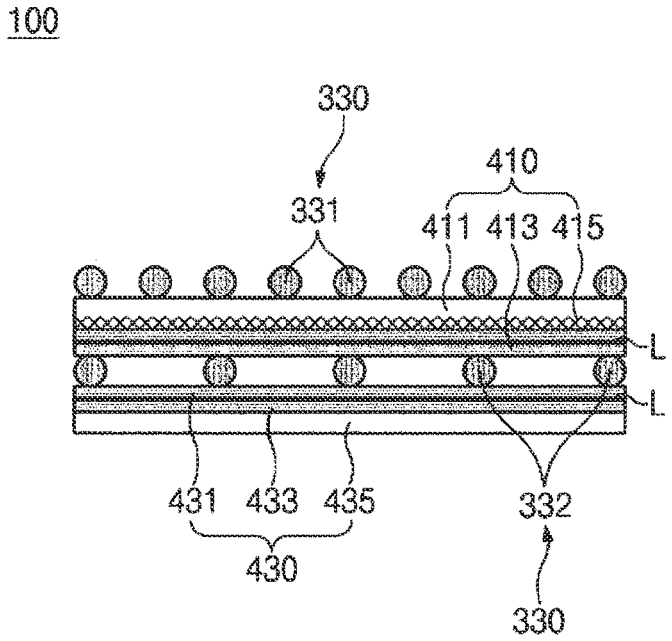
FIG. 5 is a cross-sectional view of the hair extension illustrated in FIG. 1.

For example, referring to FIGS. 4 and 5, the support member (410) further includes a tape member on the other side of the main body (411). The tape member has the first adhesive layer (413) formed on a side facing the second hairs 332) with substrate material layer (L) interposed between the tape member and the first adhesive layer (413), and an adhesive agent is applied to a side facing the first hairs (331). In addition, the lattice structure (415) is provided as a lattice net fixed between the side of the tape member facing the first hairs (331) and the main body (411).

Specifically, the tape member is in the form of a double-sided tape in which an adhesive agent is applied to both sides of the substrate material layer (L). Additionally, as one example, the main body (411) may be formed from a urethane material. The main body (411) may be formed by attaching the lattice net to the side of the tape member facing the first hairs (331) and coating the side facing the first hairs (331) and the lattice net with urethane when the support member is manufactured.

However, the material of the main body (411), and the form and the material of the lattice structure are not limited to those described above, and various other materials and forms capable of stably supporting the hair extension strands (300) may be alternatively implemented.

Such lattice structure (415) supports the main body (411) and improves the durability of the support member (410). In addition, the lattice structure (415) functions to support the adhesive member (430) to prevent or reduce damage of a hair extension (100) product due to an increase in the number of adhesive members (430) or deformation of the adhesive member (430).

Referring to FIG. 2, the release paper (435) includes a cutting part (436), a first release paper (437) and a second release paper (438). The cutting part (436) is cut and formed in a longitudinal center of the release paper (435) and is thereby cut in the direction of extension of the hair part (330). Thus, the first release paper (437) is arranged on one side of the cutting part (436) and the second release paper (438) is arranged on another side of the cutting part (436) that corresponds to the first release paper (437) relative to the cutting part (436). Furthermore, an incision part (210) is formed on the base member (200) by cutting a position corresponding to the cutting part (436) of the release paper (435).

The cutting part (436) of the release paper and the incision part (210) of the base member (200) described above facilitate attachment when the fixing part (400) is folded to attach the hair extension (100) to the subject's head, minimize the volume when the fixing part (400) is folded, and enhance adhesion to the subject's hair.

(Hair Extension According to Second and Third Embodiments)

Referring to FIGS. 6 to 9, for the second and third embodiments of the fixing part (400), methods of fixing the fixing parts (400) to the hair extension strands (300) by ring type are illustrated.

(Hair Extension According to First Embodiment)

Specifically, referring to FIG. 6, the fixing part (400) according to the second embodiment includes a ring member (450) and a fixing member (470). In addition, the fixing member (470) includes a crimp ring (471).

A plurality of the ring members (450) is provided longitudinally along the base member (200), and each ring member (450) is formed in a ring shape and is provided such that third hairs (333), which are a portion of the hair part (330), are arranged outside the ring member (450) and such that fourth hairs (334), which are a remaining portion of the hair part (330), are inserted inside the ring member (450). That is, in the second embodiment and the third embodiment described below, the third hairs (333), which are a portion of the hair part (330), are arranged outside the ring member (450) and the fourth hairs (334), which are the remaining portion of the hair part (330) other than the third hairs (333), are inserted into and through the ring member (450). The ring member (450) is then fixed to the fourth hairs (334), whereby the fixing part (400) is fixed to the hair extension strands (300).

The fixing member (470) fixes the ring member (450) to the fourth hairs (334) below the ring member (450).

Specifically, the fixing member (470) includes a crimp ring (471).

The crimp ring (471) is arranged below the ring member (450), and the ring member (450) and the crimp ring (471) are arranged adjacent to the base member (200). Then, with the fourth hairs (334) passed through the inside of the crimp ring (471), the crimp ring (471) is crimped to fix the crimp ring (471) and the ring member (450) to the fourth hairs (334). Thereafter, when the hair extension is attached to the subject's hair, the subject's hair is inserted into the ring member (450) and then the ring member (450) is crimped to fix the subject's hair to the fixing part (400), thereby connecting the hair extension strands (300) to the subject's hair.

Referring to FIGS. 7 to 9, the fixing part (400) according to the third embodiment includes the ring member (450) and the fixing member (470), and the fixing member (470) includes a fixing ring (473), a fitting ring (474) and a pulling loop (475).

The fixing ring (473) is provided below the ring member (450).

The fitting ring (474) is connected to the upper side of the fixing ring (473) and has an outer periphery formed to a size corresponding to an inner periphery of the ring member (450) so as to be press fit to the ring member (450). The pulling loop is connected and fixed to the fixing ring (473) and is passed through the fitting ring (474) and the ring member (450). Here, the fourth hairs (334) are interposed between the outer periphery of the fitting ring (474) and the inner periphery of the ring member (450).

For example, as in the embodiment illustrated in FIG. 8, the fitting ring (474) is formed to have an outer diameter so as to be press fit to the inner periphery of the ring member (450) and is fixed and connected to the upper side of the fixing ring (473). The outer diameter of the fixing ring (473) is formed larger than an inner diameter of the ring member (450). The pulling loop (475) is connected to the fitting ring (474) or the fixing ring (473) and as illustrated by way of example, is fixed by being interposed between the fitting ring (474) and the fixing ring (473).

With the fixing member (470) formed in this manner, as in the embodiment illustrated in (a) of FIG. 9, the fourth hairs (334) are arranged between the fitting ring (474) and the ring member (450), and the pulling loop (475) is passed through the ring member (450) from a lower part to an upper part thereof and pulled in a direction of the ring member (450) (direction B in (a) of FIG. 9). Thus, the fitting ring (474) is fitted into the inner periphery of the ring member (450). As a result, the fourth hairs (334) are fixed by being interposed between the ring member (450) and the fitting ring (474), whereby the ring member (450) is fixed to the fourth hairs (334) (see, (b) of FIG. 9).

(Manufacturing Method for Hair Extension)

Next, with reference to FIGS. 1 to 9, a manufacturing method for a hair extension according to an embodiment of the present invention will be described. The manufacturing method for a hair extension described below uses the configurations of the hair extension above. Thus, detailed explanation of configurations identical to those described above will be omitted below Although the manufacturing method for a hair extension described below will be described with reference to a case in which the fixing part (400) is that of the first embodiment, it is not limited thereto, and in a fixing part fixing step described below, the second and third embodiments of the fixing part (400) can both be applied.

The manufacturing method for the hair extension (100) according to an embodiment of the present invention includes a hair extension strand forming step and the fixing part fixing step.

In the hair extension strand forming step, the plurality of hair extension strands (300) are arranged on the linearly extending base member (200) and the plurality of the knot parts (310) are formed to fix the plurality of hair extension strands (300) to the base member (200) (see, FIG. 3).

In the fixing part fixing step, after the fixing part (400) is arranged longitudinally along the base member (200), the fixing part (400) is fixed to portions of the plurality of the hair parts (330) extended at the knot parts (310).

In the hair extension strand forming step, each hair part (330) is formed so as to have directionality in the direction extending from the knot part (310).

More specifically, after the hair part (330) is directed downward from the knot part (310), an adhesive agent is applied between the knot part (310) and the base member (200) to fix the knot part (310) to the base member (200) so that the hair part (330) is provided to have downward directionality from the knot part (310).

In addition, in the hair extension strand forming step, after the knot part (310) is formed on the base member (200), the adhesive agent is applied between the hair extension strands (300) and the base member (200). Thus, the hair extension strands (300) are fixed to the base member (200).

The fixing part fixing step includes a support member positioning step, a support member fixing step and an adhesive member adhering step. The fixing part fixing step further includes a support member manufacturing step before the support member positioning step.

In the support member manufacturing step, the tape member is provided on which the first adhesive layer (413) is formed on the side facing the second hairs (332) with the substrate material layer (L) interposed between the tape member and the first adhesive layer (413) and to which the adhesive agent is applied on the side facing the first hairs (331). The lattice net (lattice structure) (415) is attached to the side of the tape member facing the first hairs (331) and the side facing the first hairs (331) and the lattice net (415) are coated with urethane to form the main body (411).

In the support member positioning step, after arranging the rectangular support member (410) longitudinally along the base member (200), the first hairs (331), which are a portion of the hair part (330), are arranged on the one side of the support member (410) and the second hairs (332), which are the remaining portion of the hair part 330), are arranged on another side of the support member (410) (see, FIG. 1).

Specifically, the first hairs (331) are arranged on the one side of the plate-shaped main body (411) provided in the support member (410) and the second hairs (332), which are the remaining portion of the hair part 330) other than the first hairs (331), are arranged on the other side.

At this time, in the support member positioning step, with the support member (410) arranged on the hair part (330), the remaining portion of the hair part (330) is drawn from the one side of the support member (410) to the other side such that the second hairs (332) are arranged on the other side of the support member (410). However, the method for arranging the second hairs (332) is not limited thereto, and various other methods capable of separating and arranging the hair part (330) on one side and the other side of the support member (410) may be implemented. For example, the support member (410) can be inserted between the first hairs (331) and the second hairs (332) with the second hairs (331) and the second hairs (332) being separated.

In the support member fixing step, the third release paper (not shown) provided on the other side of the support member (410) is removed and the second hairs (332) are adhered through the first adhesive layer (413) provided on the other side of the support member (410) (see, FIG. 4). Thus, the fixing part (400) is fixed to the hair extension strands (300).

In the adhesive member adhering step, the plate-shaped adhesive member (430) having an adhesive agent applied to both sides is arranged so as to face the support member (410) with the second hairs (332) interposed between the plate-shaped adhesive member (430) and the support member (410), and the second hairs (332) are adhered to the one side of the adhesive member (430) facing the support member (410) (see, FIGS. 4 and 5).

The adhesive member (430) includes the second adhesive layer (431) that is provided on the one side for adhering the second hairs (332) to the second adhesive layer (431), the third adhesive layer (433) that is provided on another side for adhering the subject's hair to the third adhesive layer (433), and the release paper (435) that is attached to protect the third adhesive layer (433). In the adhesive member adhering step, the second hairs (332) are adhered to the second adhesive layer (431) that is provided on the one side of the adhesive member (430).

In addition, a release paper cutting step is further included after the adhesive member adhering step.

In the release paper cutting step, the longitudinal center of the release paper (435) is cut in the direction of extension of the hair part (330) to form a cutting part (436), and the first release paper (437) is provided on one side of the cutting part (436) and the second release paper (438) is provided on the other side of the cutting part (436). Such release paper cutting step facilitates attachment in folding and attaching the hair extension.

A base member cutting step of incising a center of the base member (200) to form the incision part (210) is further included. Specifically, by cutting the base member (200) at a portion (a portion corresponding to the cutting part (436) of the release paper (435)) that is folded when the hair extension is attached, the base member cutting step minimizes the volume when the hair extension is folded and enhances adhesion to the subject's hair.

Further included, after the hair extension strand forming step, is a step of cutting the base member (200) to a preset length and forming, on both ends of the base member (200), removal prevention parts which prevent removal of the knot parts (310).

The method for forming such removal prevention parts is not limited, and various embodiments capable of preventing the knot parts (310) from being removed from the ends of the base member (200) may be applied. For example, with the plurality of hair extension strands (300) fixed by the knot parts (310), the base member (200) may be cut to a desired appropriate size and then both ends of the base member (200) may be subjected to heat treatment or ultrasonic treatment to form the removal prevention parts to fix the knot parts (310) so that the knot parts (310) do not fall off.

According to the second embodiment of the fixing part (400), the fixing part fixing step includes a ring member (450) arranging step, a hair part (330) inserting step and a ring member (450) fixing step.

In the ring member (450) arranging step, the plurality of the hollow ring members (450) is arranged on the plurality of the hair extension strands (300) longitudinally along the base member (200).

In the hair part (330) inserting step, the third hairs (333), which are a portion of the hair part (330), are arranged outside each ring member (450), and the fourth hairs (334), which are the remaining portion of the hair part (330), are inserted into and through each ring member (450).

In the ring member (450) fixing step, each ring member (450) is fixed to the fourth hairs (334) by the fixing member (470). More specifically, the ring member (450) fixing step is implemented by arranging the crimp ring (471) below each ring member (450), passing the fourth hairs (334) through the crimp ring (471), and then crimping the crimp ring (471).

According to the third embodiment of the fixing part (400), in the ring member fixing step, the fixing ring (473) is arranged below each ring member (450), and with the fourth hairs (334) interposed between the outer periphery of the fitting ring that is connected to the fixing ring (473) so as to project above the fixing ring (473) and the inner periphery of the ring member (450), the pulling loop (475), which is connected to the fixing ring (473) and passed through the ring member (450), is pulled to fit and connect the fitting ring (474) to the fixing ring (473).

(Attaching Method for Hair Extension)

An attaching method for the hair extension (100) according to the above embodiments will be described below.

The attaching method for the hair extension (100) according to the present invention includes a hair extension manufacturing step and a hair extension connecting step.

The hair extension manufacturing step includes the hair extension strand forming step of arranging the plurality of the hair extension strands (300) on the linearly extending base member (200) and forming the plurality of the knot parts (310) to fix the plurality of the hair extension strands (300) to the base member (200), and the fixing part fixing step of arranging the fixing part (400) for attaching the plurality of hair extension strands (300) to the subject's hair longitudinally along the base member (200) and then fixing the fixing part (400) to portions of the plurality of the hair parts (330) extending from the plurality of the knot parts (310).

The fixing part fixing step includes the support member positioning step, the support member fixing step, the adhesive member adhering step and the release paper cutting step.

In the support member positioning step, the rectangular support member (410) is arranged longitudinally along the base member (200), and the first hairs (331), which are a portion of each hair part (330), are arranged on the one side of the support member (410) and the second hairs (332), which are the remaining portion of each hair part (330), are arranged on the other side of the support member (410).

In the support member fixing step, the third release paper (not shown) that is provided on the other side of the support member (410) is removed and the second hairs (332) are adhered through the first adhesive layer (413) that is provided on the other side of the support member (410).

In the adhesive member adhering step, the plate-shaped adhesive member (430) having the adhesive agent applied to both sides is arranged so as to face the support member (410) with the second hairs (332) interposed between the plate-shaped adhesive member (430) and the support member (410) and the second hairs (332) are adhered to the one side of the adhesive member (430) facing the support member (410).

In the release paper cutting step, the longitudinal center of the release paper (435) that is provided on another side of the adhesive member (430) is cut in the direction of extension of the hair part (330) to form the cutting part (436), and the first release paper (437) and the second release paper (438) are provided on both sides of the cutting part (436).

<Flair Extension According to First Embodiment>

The attaching method for the hair extension for the hair extension according to the first embodiment has the hair extension connecting step that includes a first attaching step and a second attaching step.

In the first attaching step, the first release paper (437) is removed and one side of the subject's hair is attached to the third adhesive layer (433).

In the second attaching step, after the first attaching step, the second release paper (438) is removed, the adhesive member (430) is folded at the cutting part (436), and another side of the subject's hair is attached to the second adhesive layer (433), Thus, providing the first release paper (437) and the second release paper (438) by the cutting part (436) formed by cutting the center of the release paper (435) facilitates attachment in folding and attaching the hair extension to the subject's hair.

Referring to FIGS. 6 to 9, the fixing part fixing step includes a ring member arranging step of arranging the plurality of the hollow ring members (450) on the plurality of the hair extension strands longitudinally along the base member, the hair part inserting step of arranging the third hairs (333), which are a portion of the hair part (330), outside each ring member (450), and inserting the fourth hairs (334), which are the remaining portion of the hair part, into and through each ring member (450), and the ring member (450) fixing step of fixing each ring member (450) to the fourth hairs by the fixing member.

<Hair Extension According to Second Embodiment>

In the hair extension connecting step of the attaching method for the hair extension for the hair extension according to the second embodiment, the subject's hair is passed through the ring member (450) and the ring member (450) is crimped to fix the subject's hair to the ring member (450).

Specifically, referring to FIG. 6, the crimp ring (471) is arranged below the ring member (450), the fourth hairs (334) are passed through the crimp ring (471), and then the crimp ring (471) is crimped to fix the ring member (450) to the fourth hairs (334). Thereafter, in the hair extension connecting step, the subject's hair is inserted into the ring member (450) and the ring member (450) is crimped to connect the hair extension to the subject's hair.

Although the crimp ring (471) may be left as is after crimping the ring member (450) to connect and fix the hair extension to the subject's hair, the crimp ring (471) may also be opened and removed to create even more natural-looking hair.

Referring to FIGS. 7 to 9, in the ring member (450) fixing step, the fixing ring (473) is arranged below the ring member (450), and with the fourth hairs (334) interposed between the outer periphery of the fitting ring (474) that is connected to the fixing ring (473) so as to project above the fixing ring (473) and the inner periphery of the ring member (450), the pulling loop (475), which is connected to the fixing ring (473) and passed through the ring member (450), is pulled to fit and connect the fitting ring to the fixing ring (473).

<Hair Extension According to Third Embodiment>

The hair extension connecting step of the attaching method for the hair extension for the hair extension according to the third embodiment includes a step of inserting at least a portion of the subject's hair into the pulling loop (475), a step of pulling the fixing ring (473) downward to pass the subject's hair through the ring member (450), and a step of crimping the ring member (450) to fix the subject's hair to the ring member (450).

Specifically, a portion of the subject's hair is inserted into the pulling loop (475) and the fixing ring (473) is pulled to pass the subject's hair through the ring member (450). Thus, the pulling loop (475) facilitates passing the subject's hair through the ring member (450), Thereafter, the ring member (450) is crimped so that both the fourth hairs (334) and the subject's hair are fixed to the inside of the ring member (450). Then, the fixing ring, the fitting ring (474) and the pulling loop (475) are removed by pulling the fixing ring (473) so that only the ring member (450) remains to create natural-looking hair.

Using the hair extension and the manufacturing and attaching methods of the hair extension according to the embodiments of the present invention as described above enables natural-looking hair to be created without excessive volume of the fixing part by forming a knot on the base member which is a linear member such as a thread to fix the hair extension strands to the base member when the hair extension strands is formed and by fixing the fixing part to the hair part of such pre-fabricated hair extension strands, compared with conventional cases in which the hair extension strands are handmade and fixed to the planar member such as a net. In addition, since the fixing part is fixed to a portion of the hair part, the remaining portion of the hair part to which the fixing part is not secured is not fixed so that each strand thereof moves individually. Thus, naturalness of the hair can be created such that the hair part can be combed after being worn by the subject.

Although the specific embodiments of the present invention have been described in detail above, the spirit and the scope of the present invention are not limited to such specific embodiments, and various modifications and variations are possible without departing from the scope of the present invention as set forth in the claims by those having ordinary knowledge in the technical field to which the present invention belongs.

REFERENCE SIGNS LIST

| | |
|---|---|
| 100: Hair extension | 200: Base member |
| 210: Incision part | 300: Hair extension strands |
| 310: Knot part | 330: Hair part |
| 331: First hairs | 332: Second hairs |
| 333: Third hairs | 334: Fourth hairs |
| 400: Fixing part | 410: Support member |
| 411: Main body | 413: First adhesive layer |
| 415: Lattice structure | 430: Adhesive member |
| 431: Second adhesive layer | 433: Third adhesive layer |
| 435: Release paper | 436: Cutting part |
| 437: First release paper | 438: Second release paper |
| 450: Ring member | 470: Fixing member |
| 471: Crimp ring | 473: Fixing ring |
| 474: Fitting ring | 475: Pulling loop |

The invention claimed is:

1. A hair extension comprising:

a linearly extending base member;

a plurality of hair extension strands to be provided longitudinally along the base member, each of the plurality of hair extension strands including a knot part being a knot formed on the base member and a hair part extending from the knot part; and a fixing part to be fixed to a portion of the hair part so as to be adjacent to the base member for connecting the plurality of the hair extension strands to the hair of a subject, wherein the fixing part includes:

a ring member formed in a ring shape and provided so that first hairs being a portion of the hair part are arranged outside the ring member and second hairs being a remaining portion of the hair part are inserted inside the ring member, wherein a plurality of the ring members are provided longitudinally along the base member; and a plurality of fixing members for fixing the plurality of the ring members, respectively, to the second hairs below each of the plurality the ring members, wherein each fixing member includes:

a fixing ring provided below a respective one the plurality of the ring members;

a fitting ring connected to an upper side of the fixing ring and having an outer periphery formed to a size corresponding to an inner periphery of the respective one of the plurality of the ring members to be press fit to the respective one of the plurality of the ring members; and a pulling loop connected and fixed to the fixing ring and passed through the fitting ring and the respective one of the plurality of the ring members for moving the fitting ring to fit and connect the fitting ring to the fixing ring, and wherein for each ring member of the plurality of the ring members, the ring member is fixed to the second hairs by the second hairs being interposed between the outer periphery of the fitting ring of a respective one of the fixing members and the inner periphery of the ring member.

2. The hair extension according to claim 1, wherein the hair part extends in a direction leading away from the knot part.

3. The hair extension according to claim 2, wherein the hair part is directed downward from the knot part, and an adhesive agent is applied between the knot part and the base member to fix the knot part to the base member so that the hair part extends in a downward direction from the knot part.

4. A manufacturing method for a hair extension, the hair extension including a linearly extending base member, a plurality of hair extension strands to be provided longitudinally along the base member, each of the plurality of hair extension strands including a knot part being a knot formed on the base member and a hair part extending from the knot part, and a fixing part to be fixed to a portion of the hair part so as to be adjacent to the base member for connecting the plurality of the hair extension strands to the hair of a subject, wherein the fixing part includes:

a ring member formed in a ring shape and provided so that first hairs being a portion of the hair part are arranged outside the ring member and second hairs being a remaining portion of the hair part are inserted inside the ring member, wherein a plurality of the ring members are provided longitudinally along the base member; and a plurality of fixing members for fixing the plurality of the ring members, respectively, to the second hairs below each of the plurality the ring members, wherein each fixing member includes:

a fixing ring provided below a respective one the plurality of the ring members;

a fitting ring connected to an upper side of the fixing ring and having an outer periphery formed to a size corresponding to an inner periphery of the respective one of the plurality of the ring members to be press fit to the respective one of the plurality of the ring members; and a pulling loop connected and fixed to the fixing ring and passed through the fitting ring and the respective one of the plurality of the ring members for moving the fitting ring to fit and connect the fitting ring to the fixing ring, wherein for each ring member of the plurality of the ring members, the ring member is fixed to the second hairs by the second hairs being interposed between the outer periphery of the fitting ring of a respective one of the fixing members and the inner periphery of the ring member, the manufacturing method comprising:

forming a hair extension strand by arranging a plurality of hair extension strands on a linearly extending base member and forming a plurality of knot parts to fix the plurality of hair extension strands to the base member; and arranging, longitudinally along the base member, the fixing part for attaching the plurality of hair extension strands to the hair of a subject, and then fixing the fixing part to portions of a plurality of hair parts extending from the plurality of knot parts, wherein the arranging and fixing of the fixing part includes:

arranging a plurality of hollow ring members on the plurality of hair extension strands longitudinally along the base member;

arranging first hairs being a portion of each of the plurality of hair parts outside each of the plurality of ring members, and inserting second hairs being a remaining portion of each of the plurality of hair parts into and through each of the plurality of ring members; and fixing each of the plurality of ring members to the second hairs with a corresponding fixing member of plurality of fixing members, respectively, wherein for each ring member and corresponding fixing member, a fixing ring of the fixing member is arranged below the ring member, and with the second hairs interposed between an outer periphery of a fitting ring connected to the fixing ring so as to project above the fixing ring and an inner periphery of the ring member, a pulling loop connected to the fixing ring and passed through the ring member is pulled to fit and connect the fitting ring to the fixing ring.

5. The manufacturing method for a hair extension according to claim 4, wherein in the forming of the hair extension strand, each of the plurality of hair parts is formed extend in a direction leading away from each of the plurality of knot parts.

6. The manufacturing method for a hair extension according to claim 4, further comprising, after the forming of the hair extension strand, cutting the base member to a preset length and forming removal prevention parts on both ends of the base member to prevent removal of the plurality of knot parts.

7. The manufacturing method for a hair extension according to claim 6, wherein in the forming of the removal prevention parts, both ends of the base member are finished by heat treatment.

8. An attaching method for a hair extension, the hair extension including a linearly extending base member, a plurality of hair extension strands to be provided longitudinally along the base member, each of the plurality of hair extension strands including a knot part being a knot formed on the base member and a hair part extending from the knot part, and a fixing part to be fixed to a portion of the hair part so as to be adjacent to the base member for connecting the plurality of the hair extension strands to the hair of a subject, wherein the fixing part includes:

a ring member formed in a ring shape and provided so that first hairs being a portion of the hair part are arranged outside the ring member and second hairs being a remaining portion of the hair part are inserted inside the ring member, wherein a plurality of the ring members are provided longitudinally along the base member; and a plurality of fixing members for fixing the plurality of the ring members, respectively, to the second hairs below each of the plurality the ring members, wherein each fixing member includes:

a fixing ring provided below a respective one the plurality of the ring members;

a fitting ring connected to an upper side of the fixing ring and having an outer periphery formed to a size corresponding to an inner periphery of the respective one of the plurality of the ring members to be press fit to the respective one of the plurality of the ring members; and a pulling loop connected and fixed to the fixing ring and passed through the fitting ring and the respective one of the plurality of the ring members for moving the fitting ring to fit and connect the fitting ring to the fixing ring, wherein for each ring member of the plurality of the ring members, the ring member is fixed to the second hairs by the second hairs being interposed between the outer periphery of the fitting ring of a respective one of the fixing members and the inner periphery of the ring member, the attaching method comprising:

manufacturing the hair extension, the manufacturing of the hair extension including forming a hair extension strand by arranging a plurality of hair extension strands on a linearly extending base member and forming a plurality of knot parts to fix the plurality of hair extension strands to the base member, and arranging, longitudinally along the base member, a fixing part for attaching the plurality of hair extension strands to the hair of a subject, and then fixing the fixing part to portions of a plurality of hair parts extending from the plurality of knot parts; and connecting the manufactured hair extension to the hair of the subject using the fixing part, wherein the arranging and the fixing of the fixing part includes:

arranging a plurality of hollow ring members on the plurality of hair extension strands longitudinally along the base member;

arranging first hairs being a portion of each of the plurality of hair parts outside each of the plurality of ring members and inserting second hairs being a remaining portion of each of the plurality of hair parts into and through each of the plurality of ring members; and fixing each of the plurality of ring members to the second hairs by a corresponding fixing member of a plurality of fixing members, wherein for each ring member and corresponding fixing member, a fixing ring of the fixing member is arranged below the ring member, and with the second hairs interposed between an outer periphery of a fitting ring connected to the fixing ring so as to project above the fixing ring and an inner periphery of the ring member, a pulling loop connected to the fixing ring and passed through the ring member is pulled to fit and connect the fitting ring to the fixing ring, wherein the connecting of the hair extension includes:

inserting at least a portion of the hair of the subject into each pulling loop;

pulling each fixing ring downward to pass the hair of the subject through each of the plurality of ring members; and crimping each of the plurality of ring members to fix the hair of the subject to each of the plurality of ring members.

* * * * *